US007065802B2

(12) United States Patent
Jung

(10) Patent No.: US 7,065,802 B2
(45) Date of Patent: Jun. 27, 2006

(54) BIDET ASSEMBLY

(76) Inventor: Brian H. Jung, 3736 Bel Pre Rd., #6, Silver Spring, MD (US) 20906

( * ) Notice: Subject to any disclaimer, the term of this patent is extended or adjusted under 35 U.S.C. 154(b) by 0 days.

(21) Appl. No.: 10/627,652

(22) Filed: Jul. 28, 2003

(65) Prior Publication Data

US 2005/0022295 A1 Feb. 3, 2005

(51) Int. Cl.
*E03D 9/08* (2006.01)

(52) U.S. Cl. ..... 4/420.2; 4/420.4; 4/447

(58) Field of Classification Search ..... 4/420.1–420.4, 4/447, 448; 137/853; 222/129, 133, 630
See application file for complete search history.

(56) References Cited

U.S. PATENT DOCUMENTS 5,097,540 A * 3/1992 Lovitt ..... 4/443
5,551,098 A * 9/1996 Wilk ..... 4/420.3
5,618,268 A * 4/1997 Raines et al. ..... 604/82
5,647,069 A * 7/1997 Han et al. ..... 4/420.2
5,807,312 A * 9/1998 Dzwonkiewicz ..... 604/30
6,671,892 B1 * 1/2004 Plyant ..... 4/420.4

* cited by examiner

*Primary Examiner*—Justine R. Yu
*Assistant Examiner*—Peter deVore

(57) ABSTRACT

A novel bidet housing formed from a plurality of nesting plastic parts having control modules formed therein which maintain a constant water pressure in the housing notwithstanding the supply water pressure used to fill the same. The control modules have knobs accessible to the user for regulating the temperature and pressure of the water, the addition of soap and/or scented material and the exit pressure to the toilet seat nozzles. The fabrication of the parts in plastic sections leads to a reduction in overall cost compared to that of the prior art as well as ease of assembly and installation.

8 Claims, 19 Drawing Sheets

CONTROL UNIT hOUSING bASE

BIDET ASSEMBLY

RELATED APPLICATION

Applicant has a pending Design application Ser. No. 29/175,264 entitled "Control Housing for a Bidet" filed on Feb. 3, 2003.

BACKGROUND OF THE INVENTION

1. Field of the Invention

The present invention relates to a bidet housing which is manufactured in sections from plastic and is thereby an improvement over the prior art bidets which have metal components in their construction. As the housing is made from plastic the same lends itself to be readily assembled and installed as well as being economical in cost.

2. Description of the Related Art

The use of bidets is common in many countries, but is less well known in the United States. This may be attributable to several factors such as a general unfamiliarity with the apparatus, the additional cost associated with the same, space constraints for incorporation of the same into a toilet system or, merely, lack of habit for such personal hygiene.

Typically, bidets are incorporated into the water supply lines of a toilet system and are positioned adjacent to the toilet seat whereby the flow, temperature and pressure of the water can be regulated for discharge from nozzles mounted on the front and rear of the toilet seat.

A prior art search of the United States Patent Office bidet classes uncovered U.S. Pat. Nos. 4,850,060, 4,967,423, 5,647,069 and 5,884,345 which typify recent developments in this area. The present bidet is a vast improvement over any bidets known to the inventor both in the method of manufacturing and the assembly of the various parts. As the parts are fabricated from inter-fitted, durable, plastic, the manufacturing costs per unit are greatly reduced, and the assembled product is both easily maintained and aesthetically pleasing.

SUMMARY OF THE INVENTION

The bidet of the present invention was developed to provide a bidet which is simple in construction, cost effective and easily installed into a toilet system.

To this end, the bidet is constructed of plastic parts including a base, a mid sub-assembly and a cover each of which have a common shape permitting the same to be readily assembled one to the other to form a unitary housing. Each of the parts has inter-fitting modules formed therein which mate with one another to form complete, individual units within which controls are disposed to regulate the flow, temperature, pressure and passage of water through the bidet as well as the dispensing of soap or scented material into the water for discharge into the nozzles disposed on a toilet seat.

The present bidet housing can be manufactured and assembled in combination with a toilet seat and sold as a package along with hoses for connecting the same to water supply lines and to nozzles disposed on the seat. Alternatively, the bidet housing can be sold as a unit which can be added to a toilet system.

The design of the bidet either as a package with a toilet seat or as an add-on permits the same to be easily installed and mounted adjacent a toilet seat without requiring special tools or skill for accomplishing the same.

BRIEF DESCRIPTION OF THE DRAWINGS

FIG. 8*a* shows a colored cross-section of the housing of FIG. 8.

DESCRIPTION OF THE PREFERRED EMBODIMENT

Figure 1:
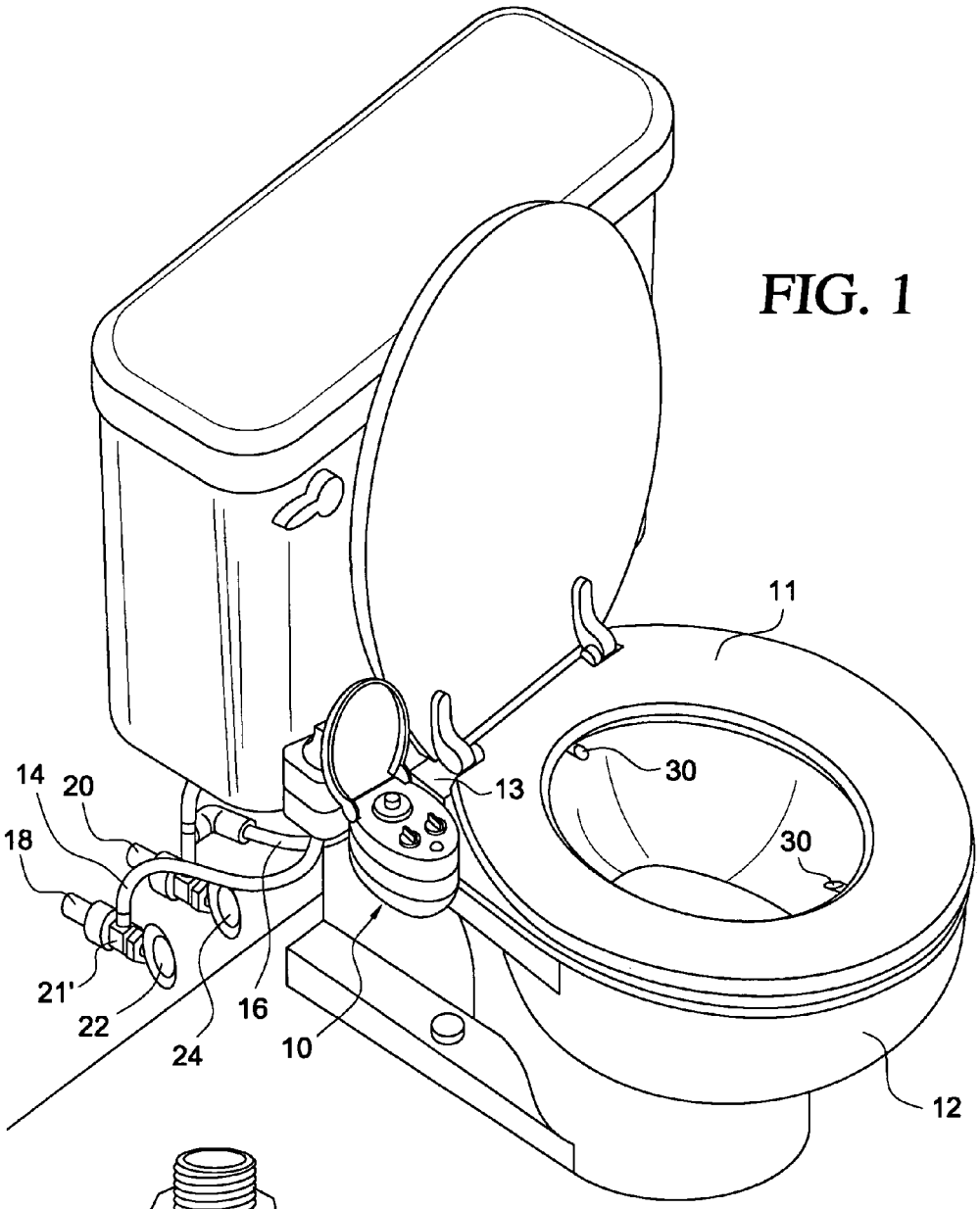
FIG. 1 is a perspective view showing the bidet housing mounted alongside a toilet seat.
Figure 1A:
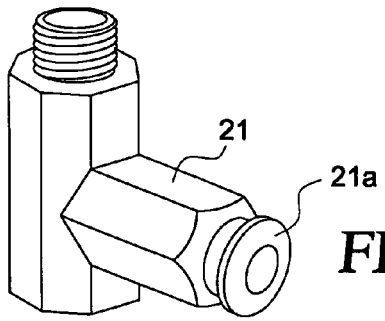
FIG. 1*a* shows a quick-connect fitting which facilitates installation of the bidet.

With reference to FIG. 1 of the drawings, the control unit of the bidet is designated generally at 10 and is seen to be supported adjacent the toilet seat 11 of a toilet 12 within reach of the user. Hoses 14, 16 are quick-connected to hot water 18 and cold water 20 piping and are introduced into the bottom of the unit 10. To facilitate the connection, a special T-shaped member 21, seen in FIG. 1*a*, is utilized and includes an adjustable outlet 21*a* to compensate for space constraints during the connection. The flow of water into the houses 14, 16 is controlled by conventional valves 22, 24. In use, water passes through the unit 10 in a controlled fashion, as will be explained hereinafter, and through hoses, not seen due to their location in the toilet seat bracket 13, and into and out of nozzles 30, 30 mounted at the front and rear of toilet seat 11.

Figure 2:
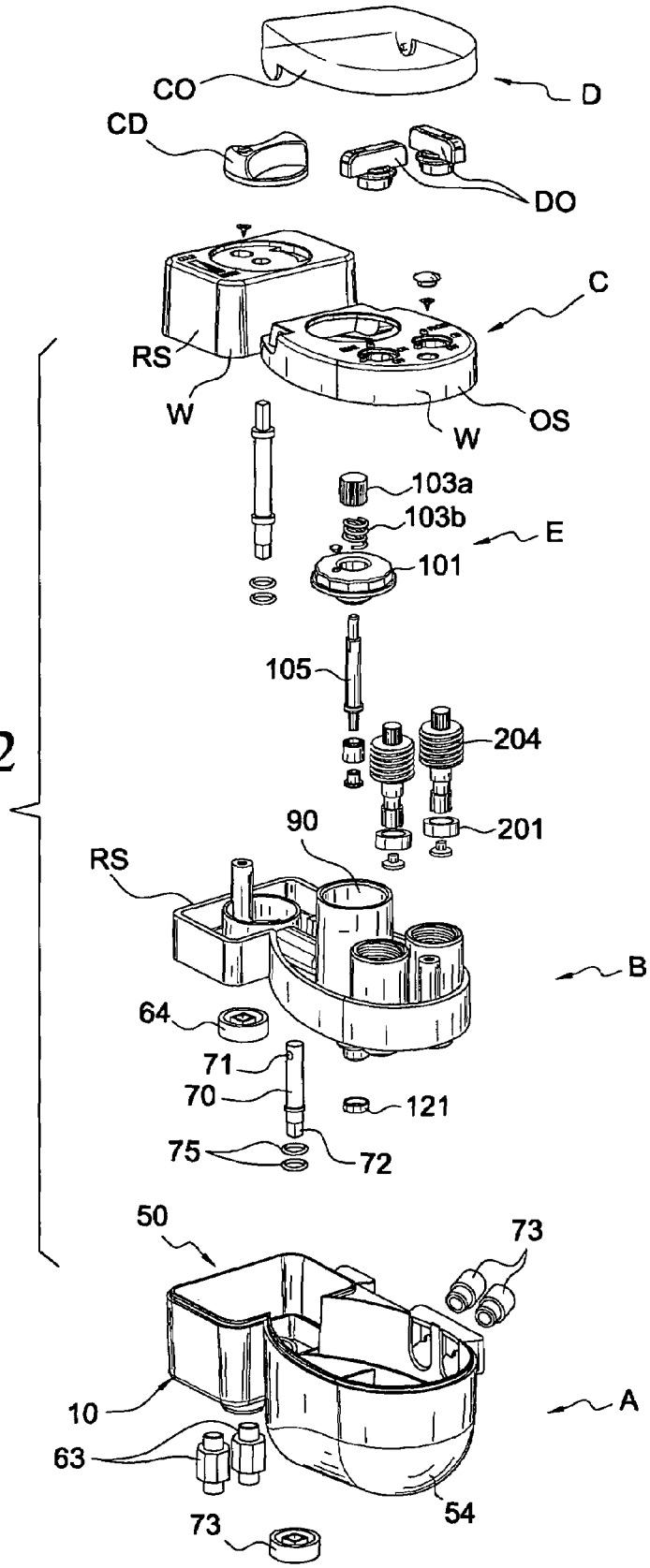
FIG. 2 shows an exploded assembly view of the parts of the bidet and their relationship with base A, mid sub-assembly B and the cover C.

For a clearer explanation of the invention, the parts of the bidet are shown in an exploded view in FIG. 2, with the major component parts designated as A, B and C. As seen, these parts have a basic, common shape including a rectangular section RS adjacent to an ovoid-shape member OS and a wall W disposed about the entire perimeter thereof which, when the parts are nested together, will form a complete outer housing which is compact and attractive. Additionally, each part, A, B, C, has interior partial module sections which, when mated together form housings for the controls, which regulate the passage of water therethrough.

Water Flow through the Bidet

Figure 8:
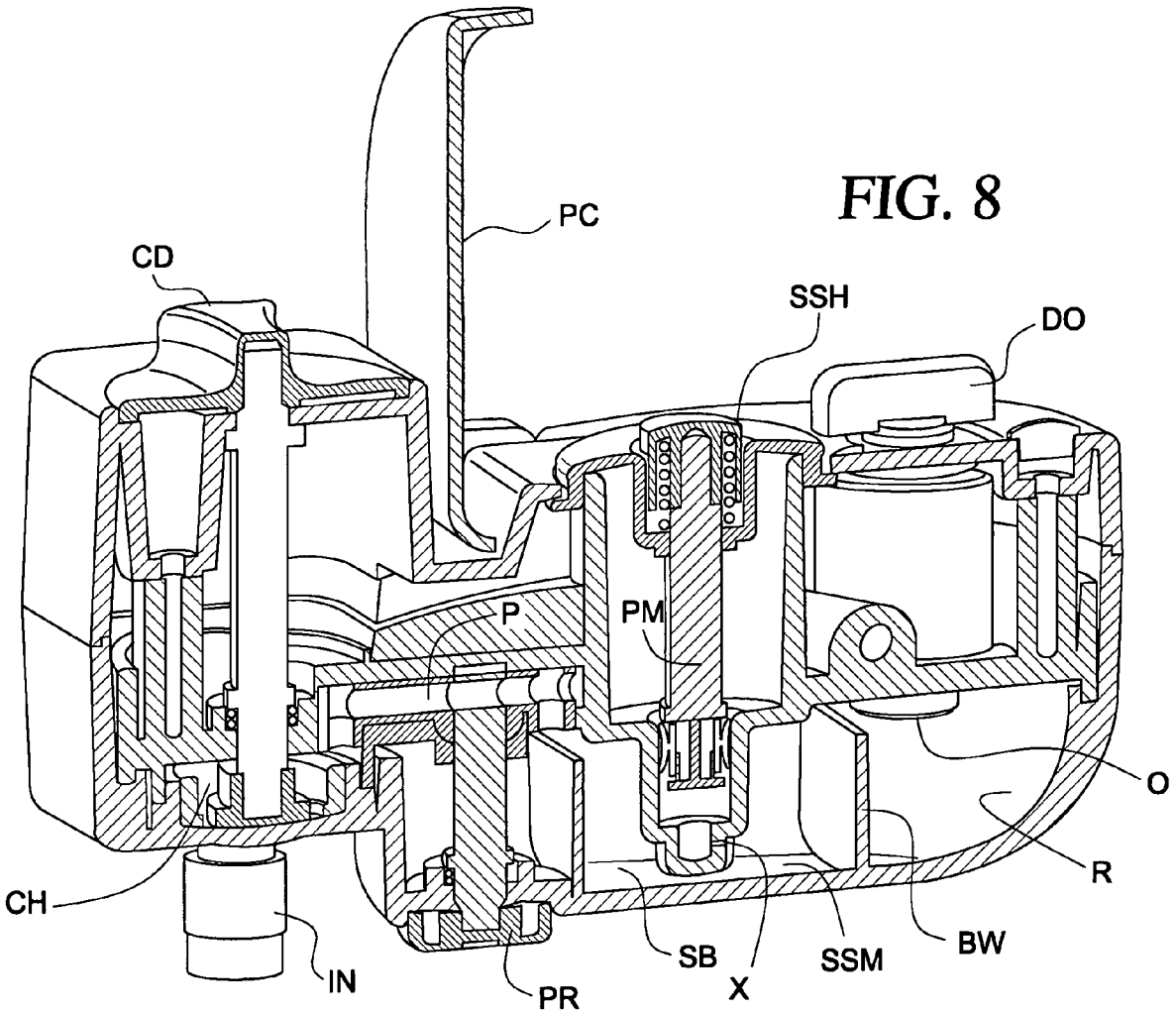
FIG. 8 shows a colored vertical sectional view of the housing, the module parts, and the controls for regulating the water flow therethrough.

In describing the function and flow of water through the bidet 10, ones attention is directed to FIG. 1 in combination with FIGS. 2 and 8 wherein water from hot 18 and cold 20 supply lines enter the chamber CH through inlets IN and passes therefrom into a conduit passageway P into supply base SB whereat soap and/or scented material SSM are present and mixed with the water, whereafter the mixture passes over a baffle wall BW into a reservoir R and then into and out of a pair of openings OO into a pair of flexible hoses, not seen, to front and rear nozzles 30, 30 disposed on toilet seat 11.

Specifically, a control dial CD in chamber CH regulates the size of openings, not shown, disposed above the inlets IN and thereby the amount and temperature of hot and cold water entering chamber CH, and thence into passageway P. It is to be noted that in some instances there may be only one water supply line and, hence, only one connection will be made. This passageway P has a dial controlled pressure regulator PR disposed therein which regulates the water pressure as it passes into supply base SB. At this point the soap/scent is pumped out of housing SSH through outlet X in response to piston movement PM. This mixture passes over baffle wall BW into a reservoir R whereat hand-manipulated dials DO, DO control openings O,O to regulate the flow to the nozzles 30, 30. A pivoted cover PC over lies and protects the dials and permits the dials to be accessed by lifting the same.

Base A

Figure 3:
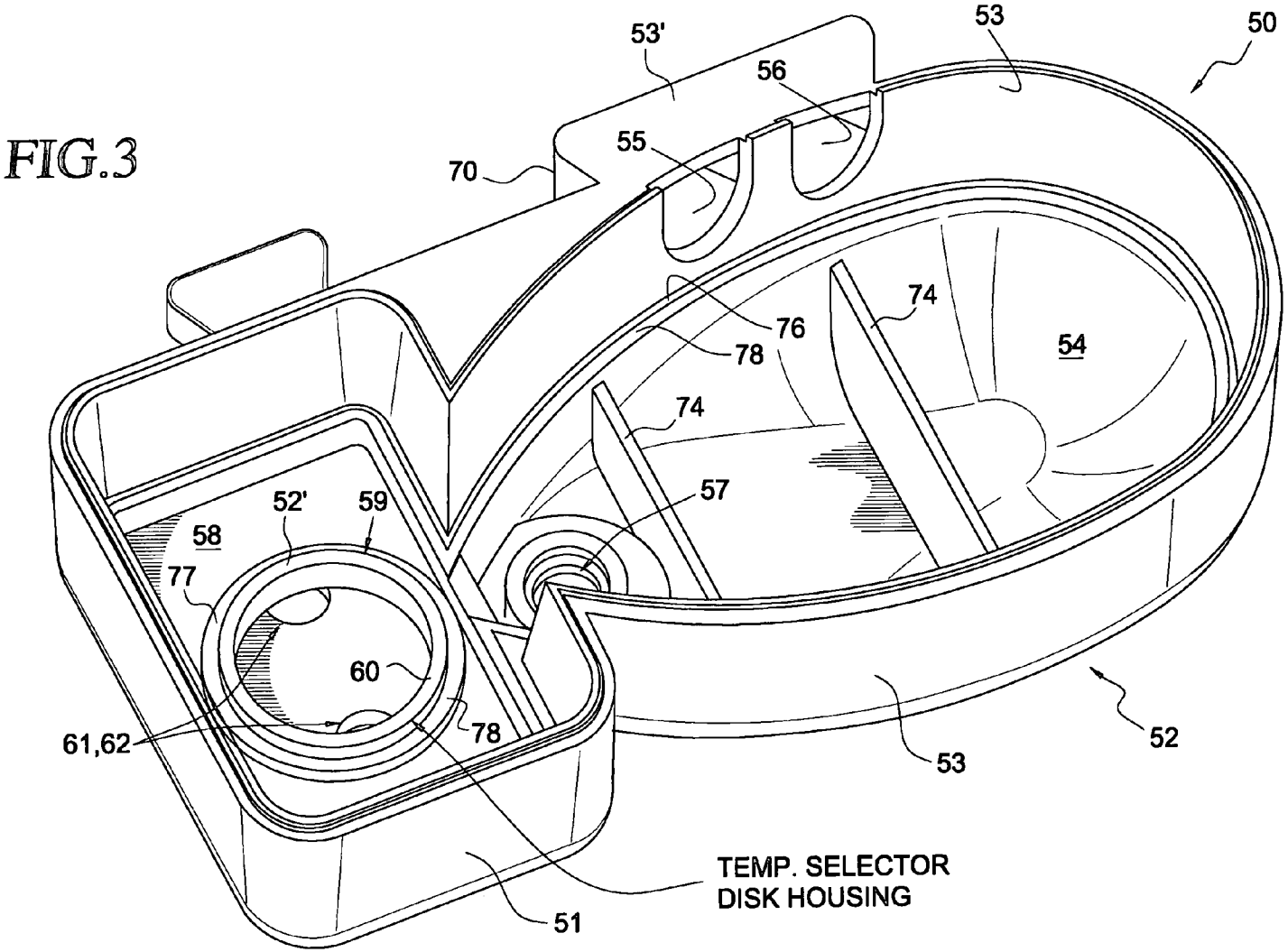
FIGS. 3 and 4 show various views and details of the base A.
Figure 3A:
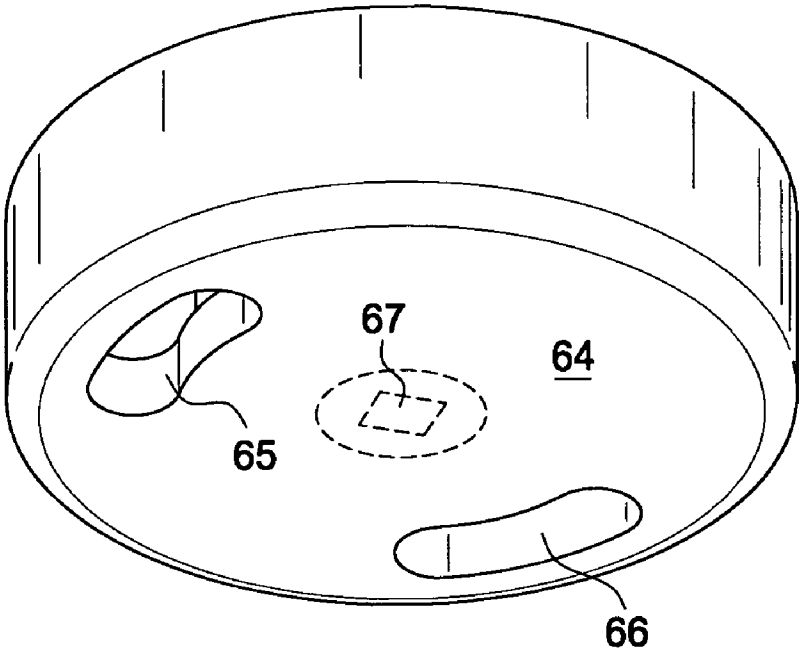
FIG. 3*a* shows details of a disk controlling water flow through inlets.
Figure 4:
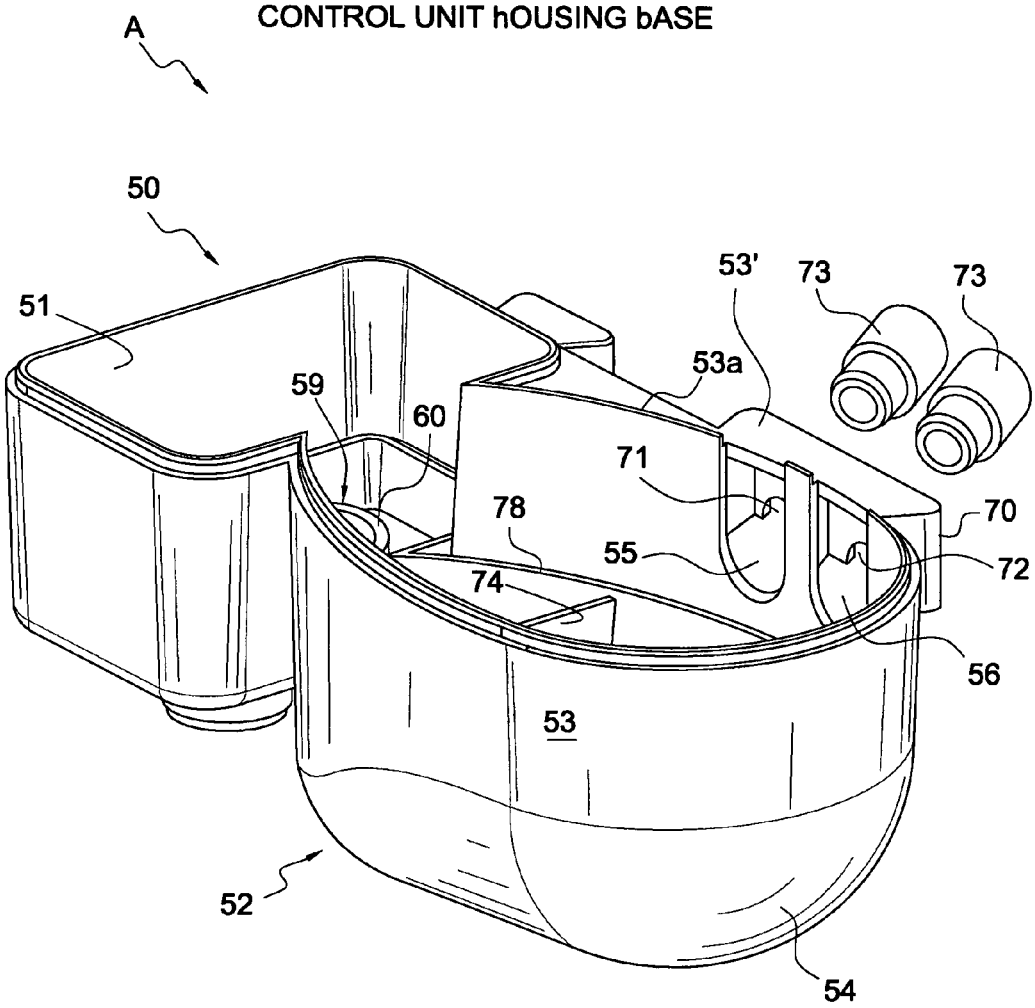

The base A, designated generally at 50, is seen in greater detail in FIGS. 3 and 4 whereat the rectangular 51 and ovoid 52 sections are defined by a wall 53 extending around the perimeter thereof. The ovoid section 52 is of a bowl shape 54 and is provided with two spaced openings 55, 56 in the wall 53 and a vertical opening 57 adjacent the rectangular section 51 which will house the pressure regulator PR, as will be explained hereinafter. The base 58 of the rectangular section 51 is provided with a circular housing 59 defined by an upstanding wall 60 having a pair of diametrically disposed openings 61, 62 with fittings 63, 63 in communication therewith, see FIG. 2, and the hot and cold water hoses 14, 16 of the main hot 18 and cold 20 water lines of the establishment, see FIG. 1. The circular housing 59 receives a complementary shaped rotatable disk 64, see FIG. 3*a*, which also has a pair of diametrically disposed arcuate openings 65, 66 which align with the openings 61, 62 of the circular housing 59. The openings 65, 66 will control the flow and regulate the temperature of hot and cold water into section 51 by selectively masking the openings 61, 62. The disk 64 has a square central opening 67 within which a control shaft, to be described later, is disposed for rotating the disk 64.

The opening 57 at the top of the bowl 52 adjacent the rectangular section 51 receives a pressure control shaft 70 therein, see FIG. 2, having a portion extending upwardly with a transverse hole 71 extending therethrough and a downwardly extending portion 72 disposed outside of the bottom of base 58 receiving a control knob 73 thereon which will ultimately control the water pressure as the opening 71 will be adjusted in the passageway P to control the water flow therethrough, as explained hereinafter. The lower portion 72 of the shaft is square-shaped and fits into a complementary opening in the knob 73 to secure the same together. A pair of washers 75, 75 are disposed bout the shaft at the bottom of the base and above the square-shaped opening to prevent the flow of water up the shaft 70.

With continuing reference to FIGS. 2 and 3 and now FIG. 4, the pair of spaced openings 55, 56 in the upstanding wall 53 are protected by a cover 53' extending thereover with a vertical depending surface 70 having a pair of beveled or slanted openings 71, 72 aligned with the openings 55, 56. Fittings 73, 73 will be inserted into these openings and will be connected to individual hoses leading to the toilet seat 11 and the nozzles 30, 30 positioned therein. Additionally, a pair of spaced braces 74, 74 are transversely disposed in the bowl 54 serving to rigidify the bowl which would, without the braces, flex inwardly and outwardly in response to the varying water pressure and ultimately cause damage to the bowl. The braces 74, 74 negate this condition. During fabrication of this part, plastic fusion lines 76, 77 are respectively disposed on a ledge 78 following the inner outline of the bowl 52 and rectangular chamber 51 and around the circular housing 59, which are utilized to fuse part B to part A during the assembly process.

Mid Sub-Assembly B

Figure 5:
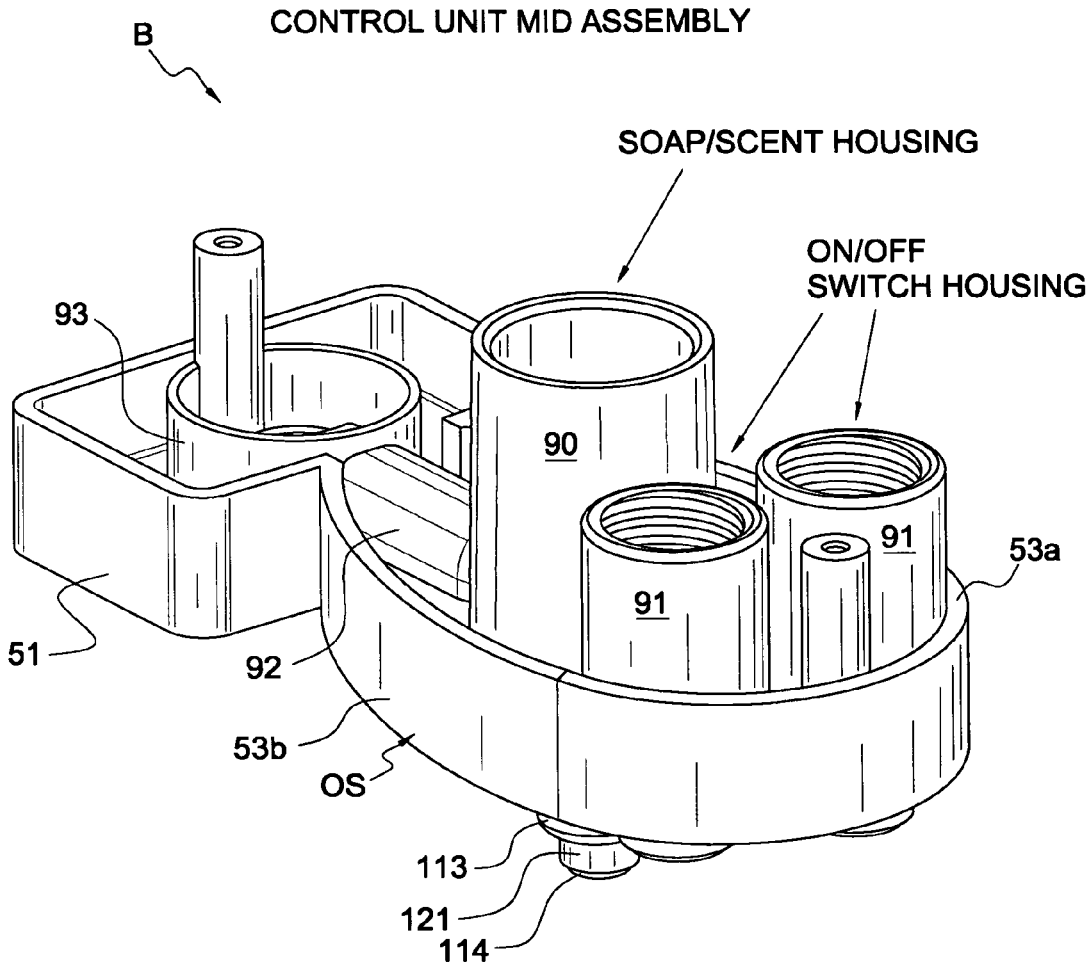
FIGS. 5 and 6 show various views of the mid sub-assembly B and details of the modules disposed thereon.
Figure 6:
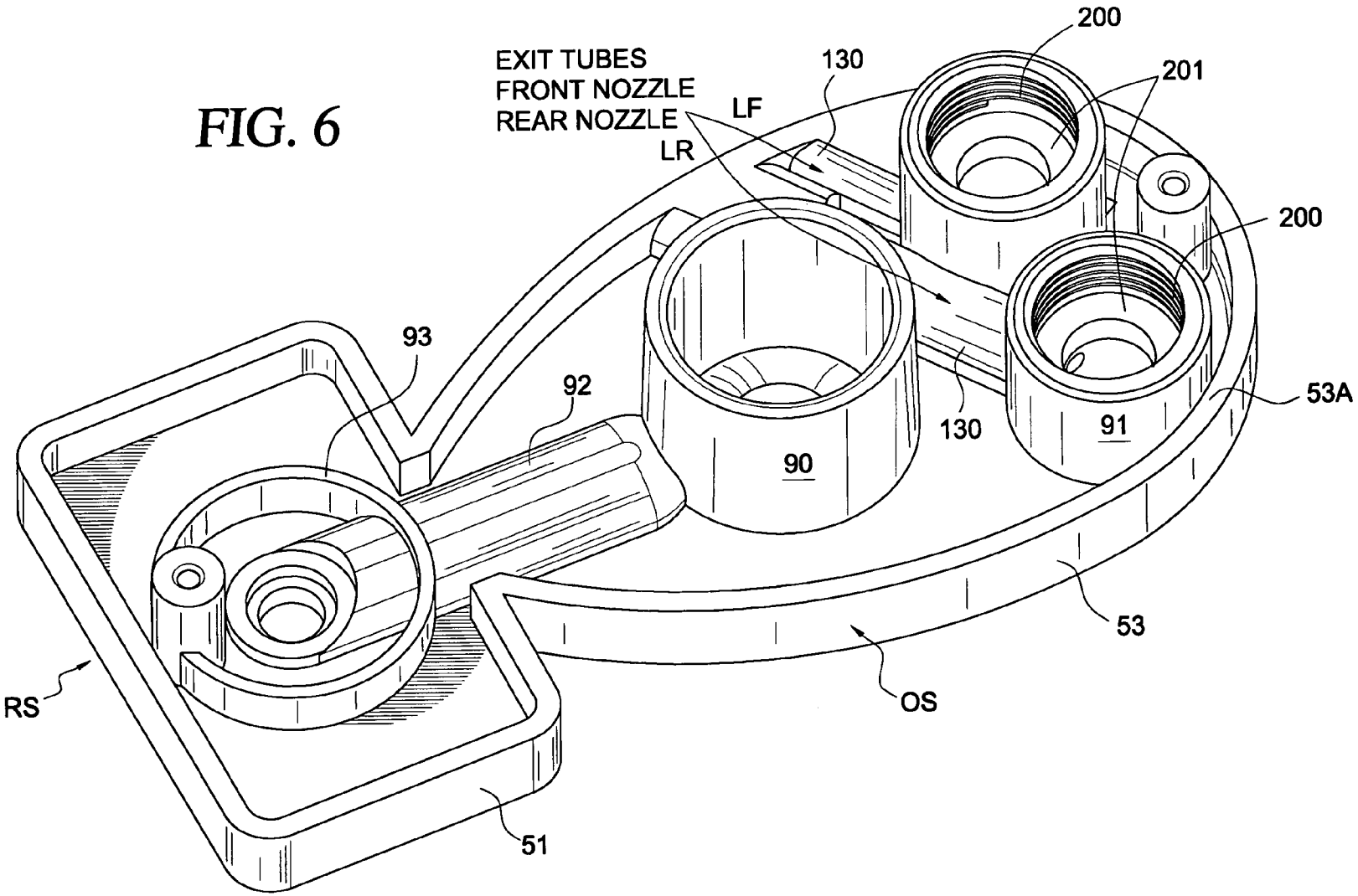
Figure 7:
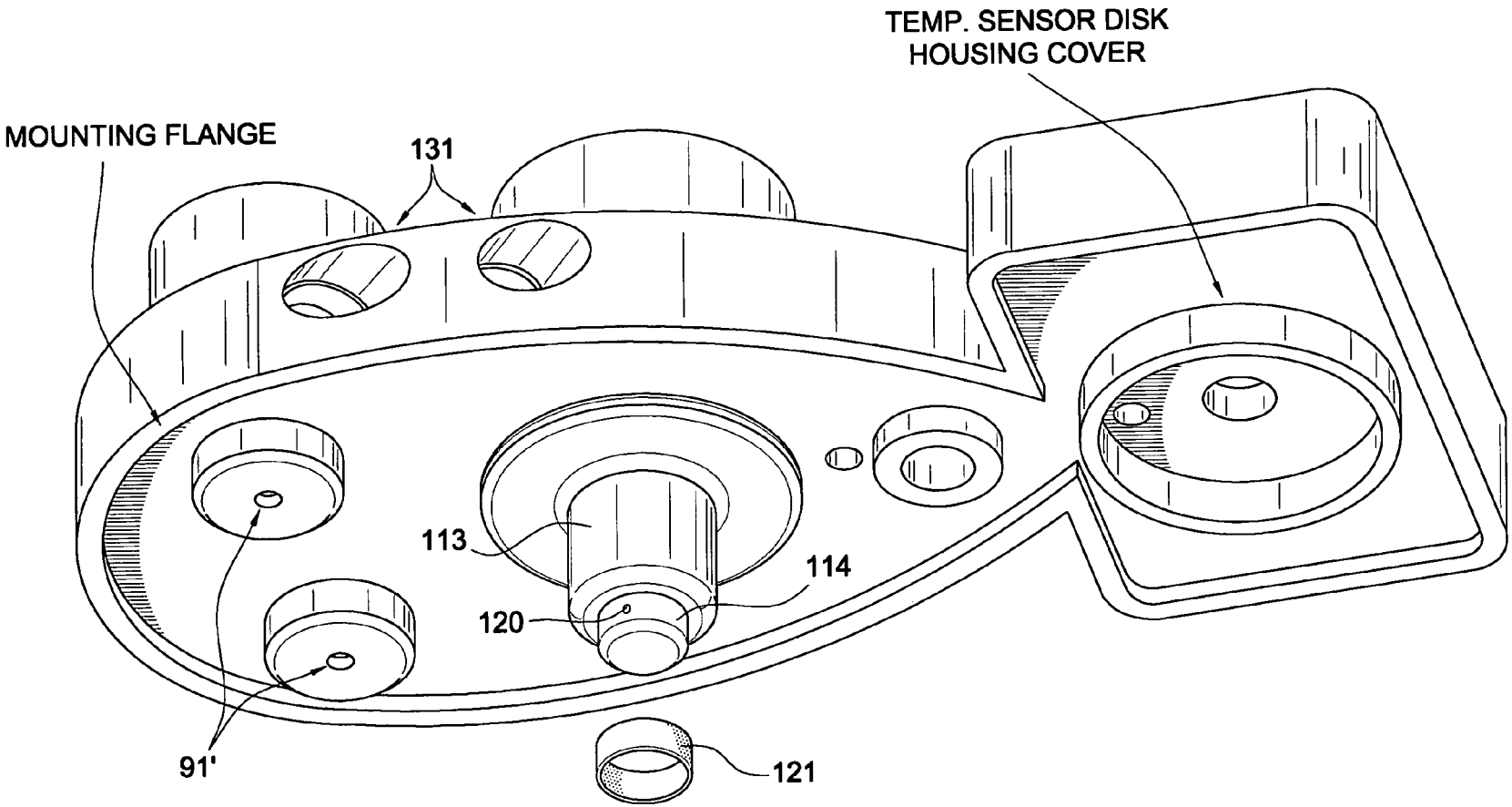
FIG. 7 shows a bottom view of the mid sub-assembly B and the details of the lowermost parts of the modules.
Figure 9:
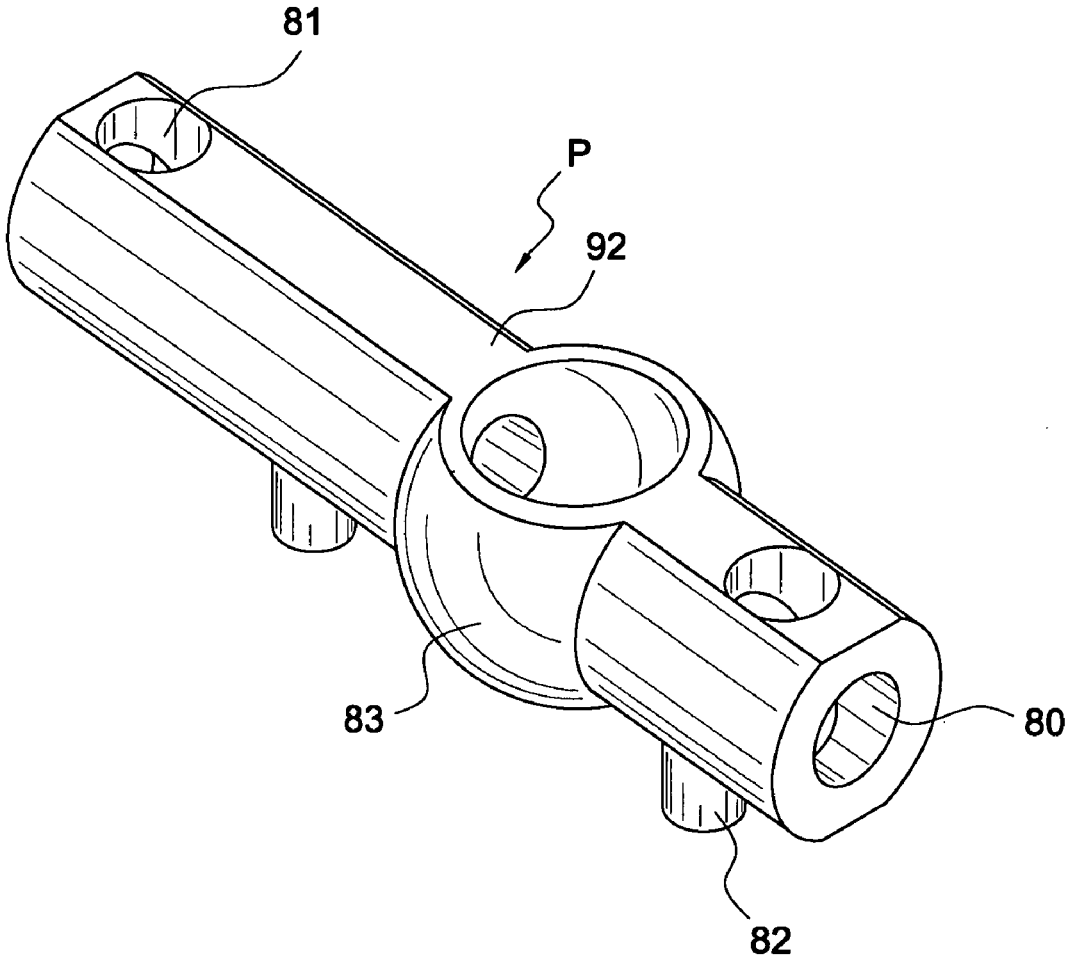
FIG. 9 shows details of the passageway P.

Again, as seen in FIG. 2 and the enlarged views of FIGS. 5, 6 and 7, the assembly B is of the same general shape as base A differing in that the dimensions are slightly smaller to permit the same to nest entirely in base A with the top wall 53*a* thereof being flush after assembly with the top wall 53*a* of base A. The base of B in the OS section is provided with three circular upstanding housings 90, 91 and 91, each of which are adapted to receive various control components. The largest of the housings 90 will serve as a reservoir for soap, scented material or a combination thereof while the two identical housings 91, 91 will receive control dials to regulate passage of water through the fittings 73, 73 and the hoses leading to the toilet seat nozzles 30, 30. The rectangular section 51 has a circular housing 93 with an opening therein which aligns with the circular housing 59 in section 51 of the base and disk 64 positioned therein. A conduit 92, passageway P, extends into circular housing 93 in the rectangular section and into the circular housing 90 and is used to conduct the mix of the hot and cold water to the base chamber SB. The details of the conduit 92 in FIG. 9 are seen to be elongated in shape with a passageway 80 extending the length thereof. Inlet and outlet ports 81, 82, respectively, are formed at either end for introducing and exiting the water into and out of the passageway 80. A circular bulbous section 83 is formed in the passageway 80 within which the hole 71 of pressure control shaft 70 is disposed, which, when rotated in response to movement of dial 73, the same will be selectively moved into and out of alignment with passageway 80 thereby causing the flow and pressure of the water to be regulated into chamber SB.

Figure 10:
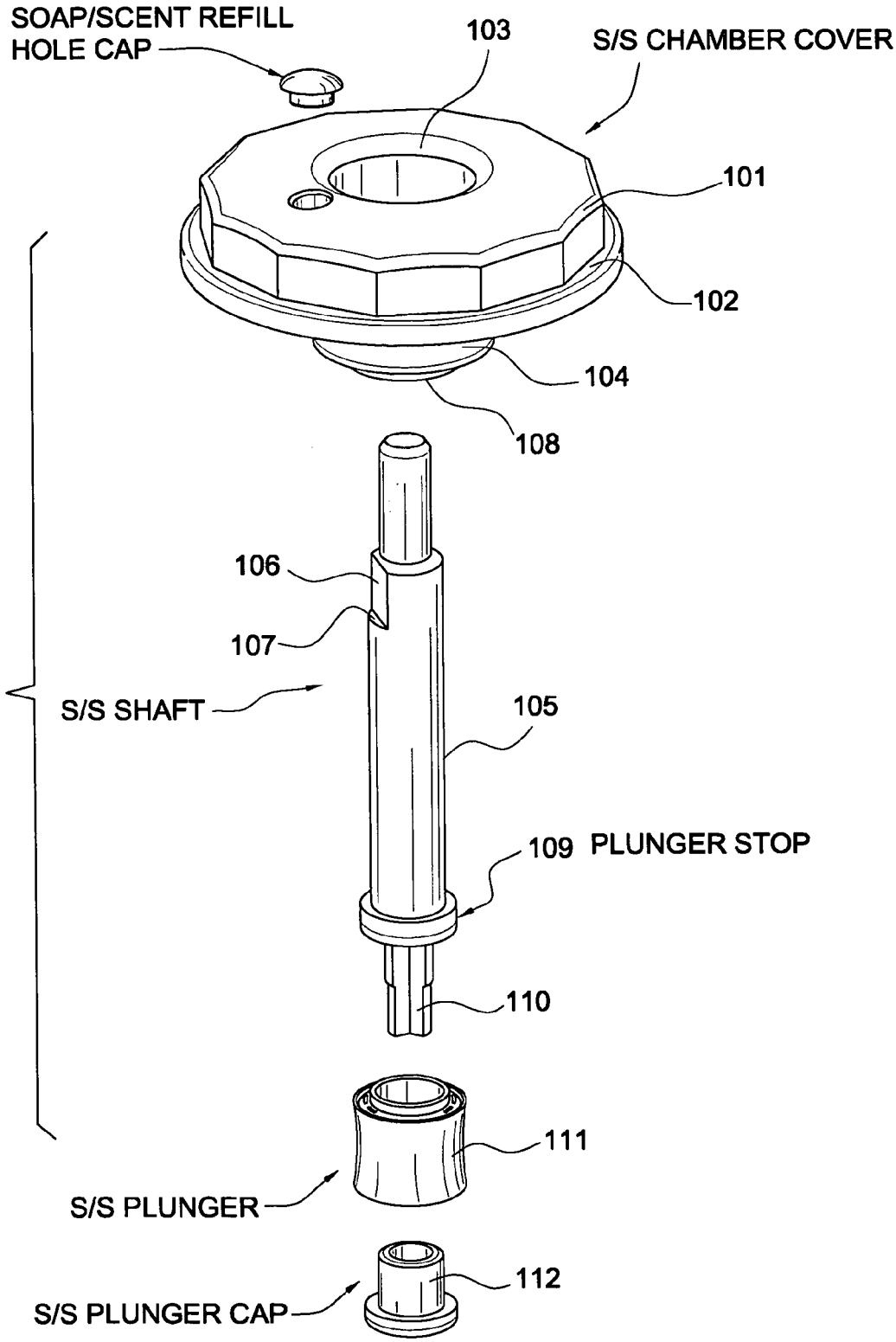
FIG. 10 shows the details of the pump assembly.

A pump assembly generally indicated at 100, shown in the exploded view of FIG. 10 and at E in FIG. 2, is disposed within the large circular housing 90 and controls the discharge of soap and/or scent therefrom into the water, and includes a cap 101 with a depending flange 102 which will engage and circumscribe the top of the housing 90. The cap 101 is provided with a control opening 103 having a finger-engaging knob 103*a*, see FIG. 2 positioned therein which nests in a smaller circular housing 104 on the underside of the cap 101. The cap 101 supports a spring-biased 103*b* reciprocating plunger shaft 105 extending downwardly therefrom. The top of the shaft has a cut-out 106 forming a ledge 107 which engages a ring member 108 at the bottom of the housing 104 to limit upward movement of the shaft upon its return stroke in response to the upward bias of the spring 103*b*. The bottom of the shaft is provided with a ring-shaped detent 109 positioned above a plurality of radially extending ribs 110, 110. A resilient, flexible collar 111 covers the ribs 110 and is secured in place by plunger cap 112 which engages the ribs 110. When assembly 100 is inserted into the housing 90, the lower most portion of the plunger shaft 105, the ribs 110, 110, collar 11 and cap 112 are slidably disposed in the depending circular portion 113, 114 whereby reciprocating movement of the plunger will force fluid out of portion 120 into chamber 5B as described hereinafter.

With reference to FIG. 7, the details of the bottom of the mid sub-assembly B are seen with the housings 90, 91, 91 having extensions terminating in smaller circular segments integrally formed thereon. The extension of housing 90 has stepped circular segments 113, 114 with the lowermost segment 114 having an opening 120 therein. The hole 120 communicates with the interior reservoir of housing 90 and is the exit for the soap/scent to be dispensed. A flexible, resilient collar 121 covers the opening 120 and flexes outwardly in response to the reciprocating movement of the piston P to ensure that the fluid will be discharged notwithstanding the water pressure present in the bowl.

With continuing reference to the top views of mid sub-assembly B as seen in FIGS. 5 and 6, housings 91, 91 each have closed channel members 130, 130 in communication with the interior thereof for conducting fluid to the fittings 73, 73 which are held captive in the slanted openings 131,131 formed in the wall 53 which are aligned with the openings 55; 56 in the base member A. In the manufacture of the sub-assembly B, the fittings are preferably disposed in the openings 131, 131 and when part B is nested within part A the nipples 73, 73 will seat within the lower base openings 55, 56 respectively.

Figure 11:
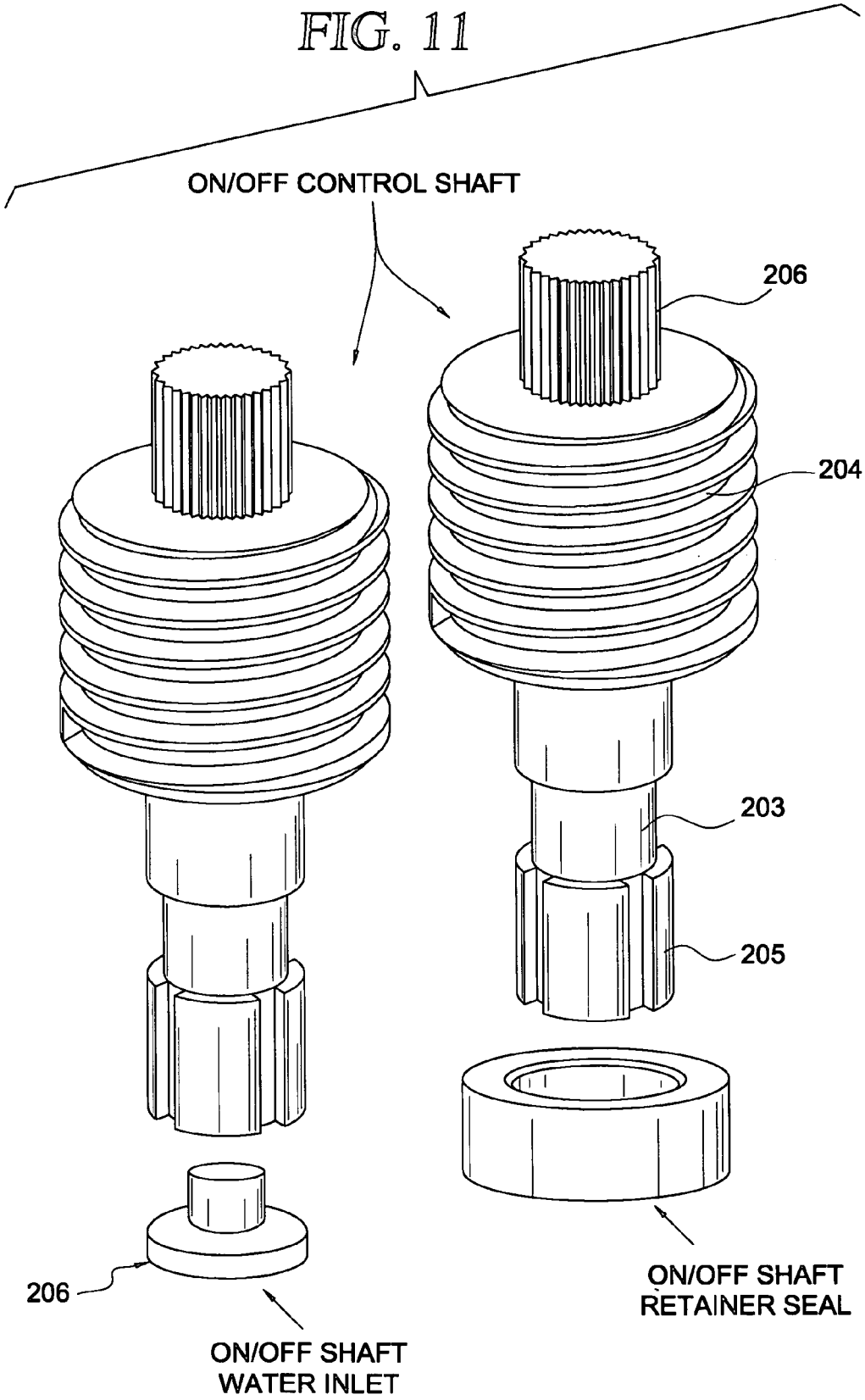
FIG. 11 shows the details of the valves controlling water out of the bidet housing.

Also as seen, the interior of the housings 91, 91 are threaded at 200, 200 and have washers 201, 201 seated at the base thereof to surround identical control valve members 202, 202 disposed in each. Valve members 202, 202, see FIG. 11, each have a hollow shaft 203 having a threaded section 204 at the top thereof engaging the threads 200, 200 of the housing for adjustable movement into and out of the housings 91, 91. The lower end of each of the shafts 203, 203 is similar to the structure of the housing plunger 105 and includes a plurality of radially extending ribs 205, 205 formed thereon and a packing 206 inserted onto the bottom of the hollow shaft 203 and about the ribs 205, 205 which cooperate with the openings 92, 92 disposed at the bottom of housings 91, 91 to prevent the flow of water upwardly about the shaft 203. The top of the shaft 203 has a serrated surface 206 which the handle DO frictionally engages for rotatably displacing the valves 202, 202 to regulate the flow of water through the openings 92, 92.

Seat Nozzle Mounting

Figure 12:
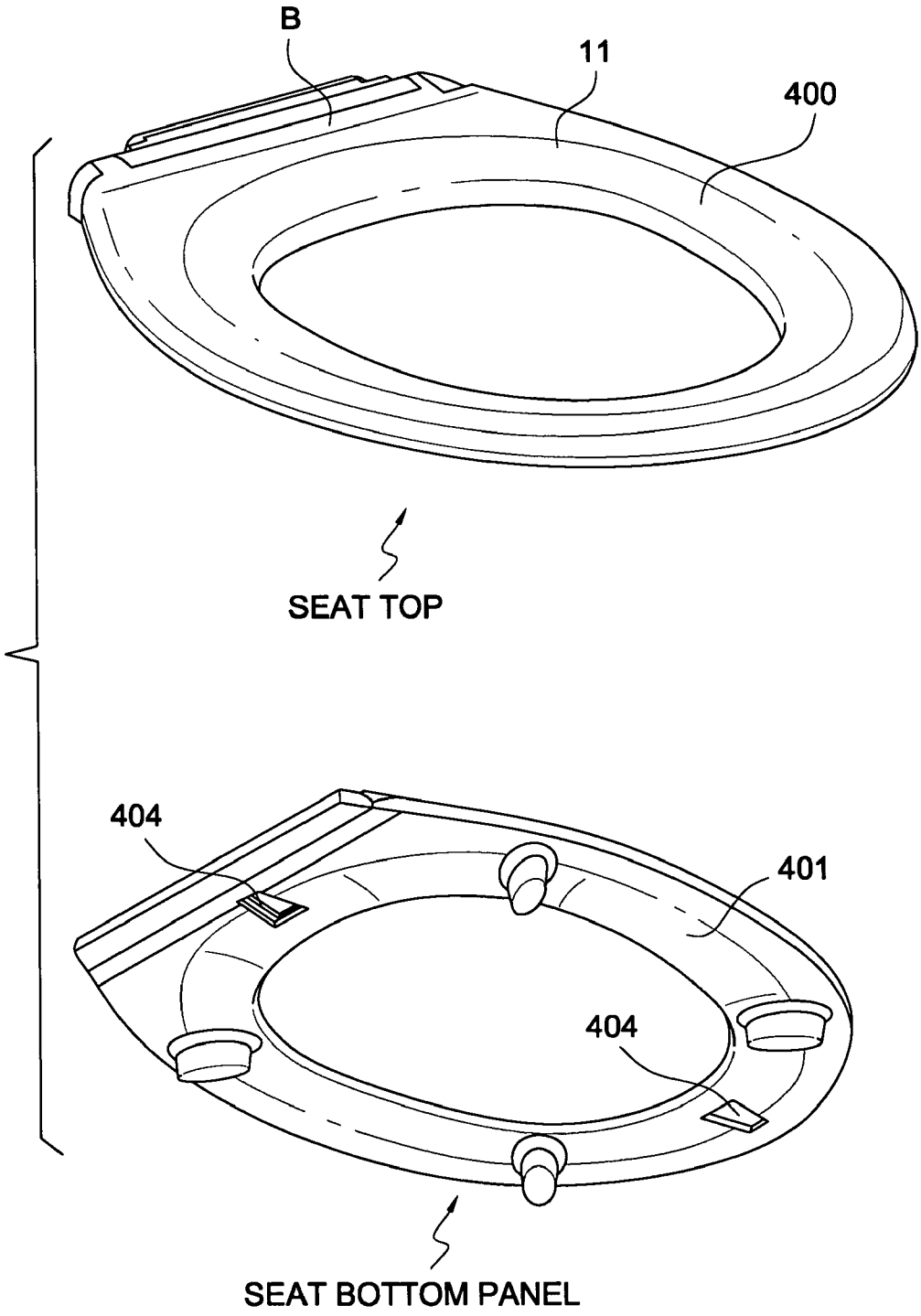
FIGS. 12 and 13 show detail views of the toilet seat.
Figure 13:
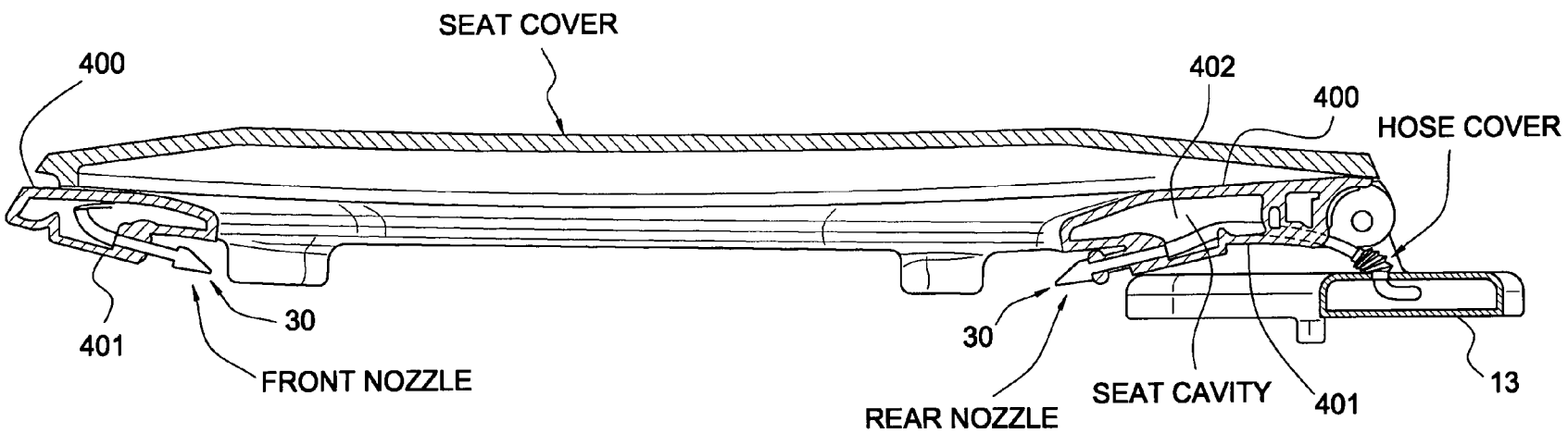
Figure 14:
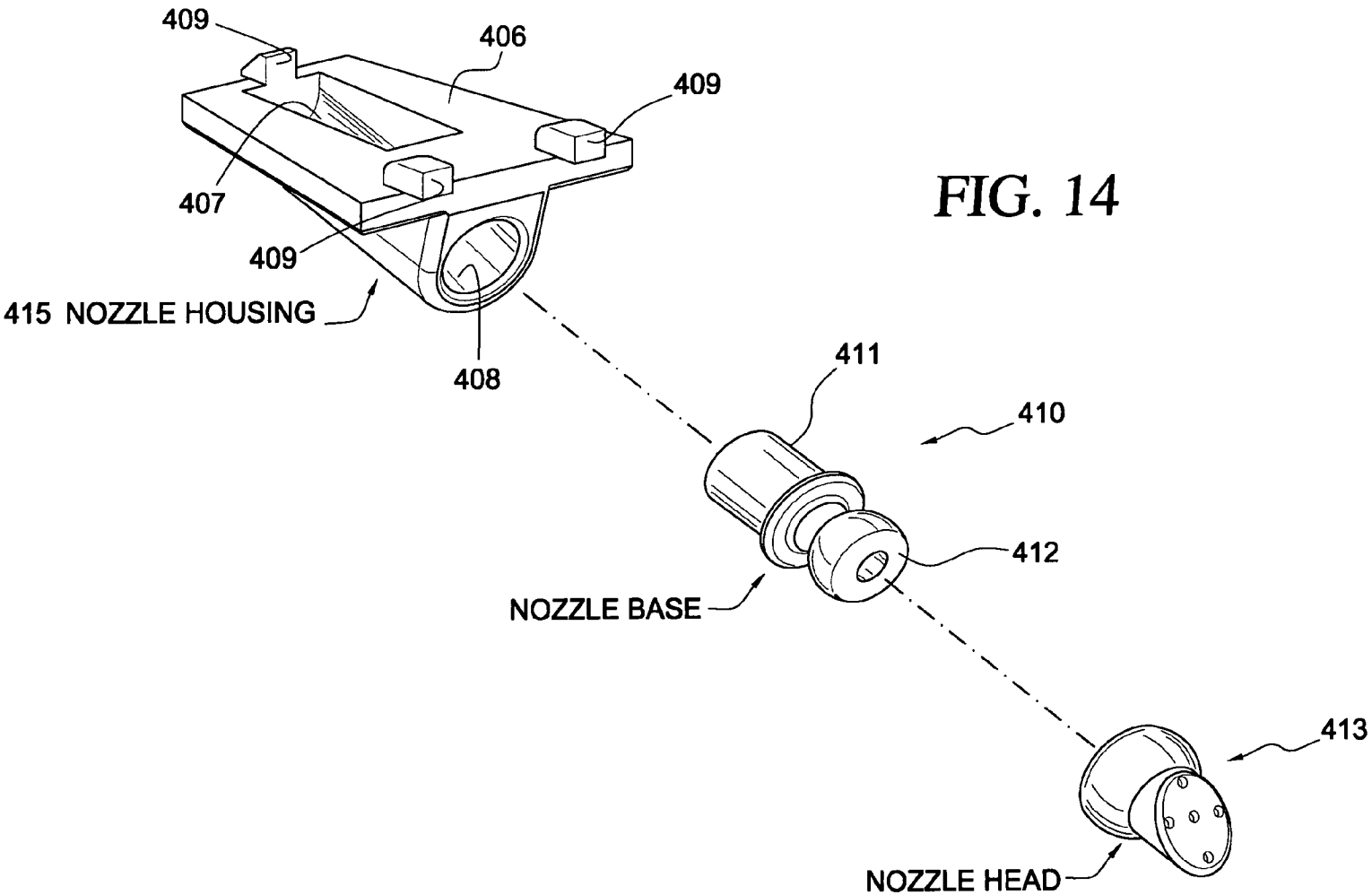
FIG. 14 shows the details of the nozzle mounting means.

The toilet seat 11 of FIG. 1 is formed with atop 400 and a mating bottom 401, see FIGS. 12 and 13, to form a hollow interior 402 for housing the hoses H. H conducting the fluid from fittings 73, 73 to the back and front nozzles 30, 30. With reference to FIG. 12, the bottom 401 is seen to have front and rear openings 404, 404 adapted to receive the nozzle support housings 405, 405 of FIG. 13 therein. Each of the housings 405, 405 of FIG. 14 include a flat tapered base 406 matching the shape of the opening 404 with an opening 407 in the base 406 communicating with an outlet opening 408 formed at the bottom of the base. Flexible snap members 409, 409 are positioned about the base for snapping and securing the same in the openings 404, 404.

The outlet opening 408 accommodates a nozzle base 410 having an annular shape 411 at one end complementary to the opening 408 for mounting therein and a spherical adapter head 412 at the other end engaging a nozzle head 413 thereon permitting directional adjustment thereof as desired by the user.

Bidet Hose Connection to Toilet Seat

Figure 15:
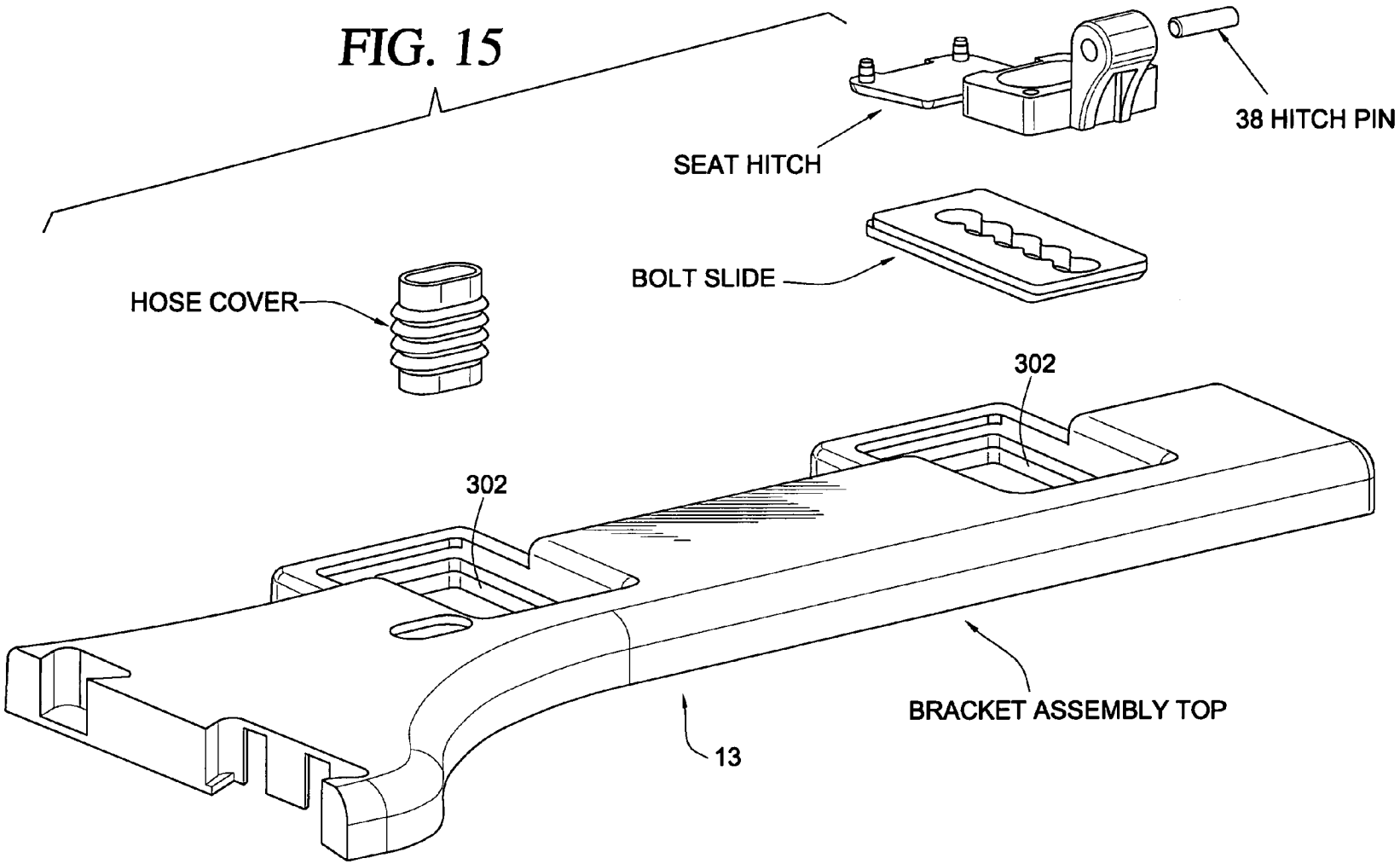
FIGS. 15 and 16 show the details of the bracket.
Figure 16:
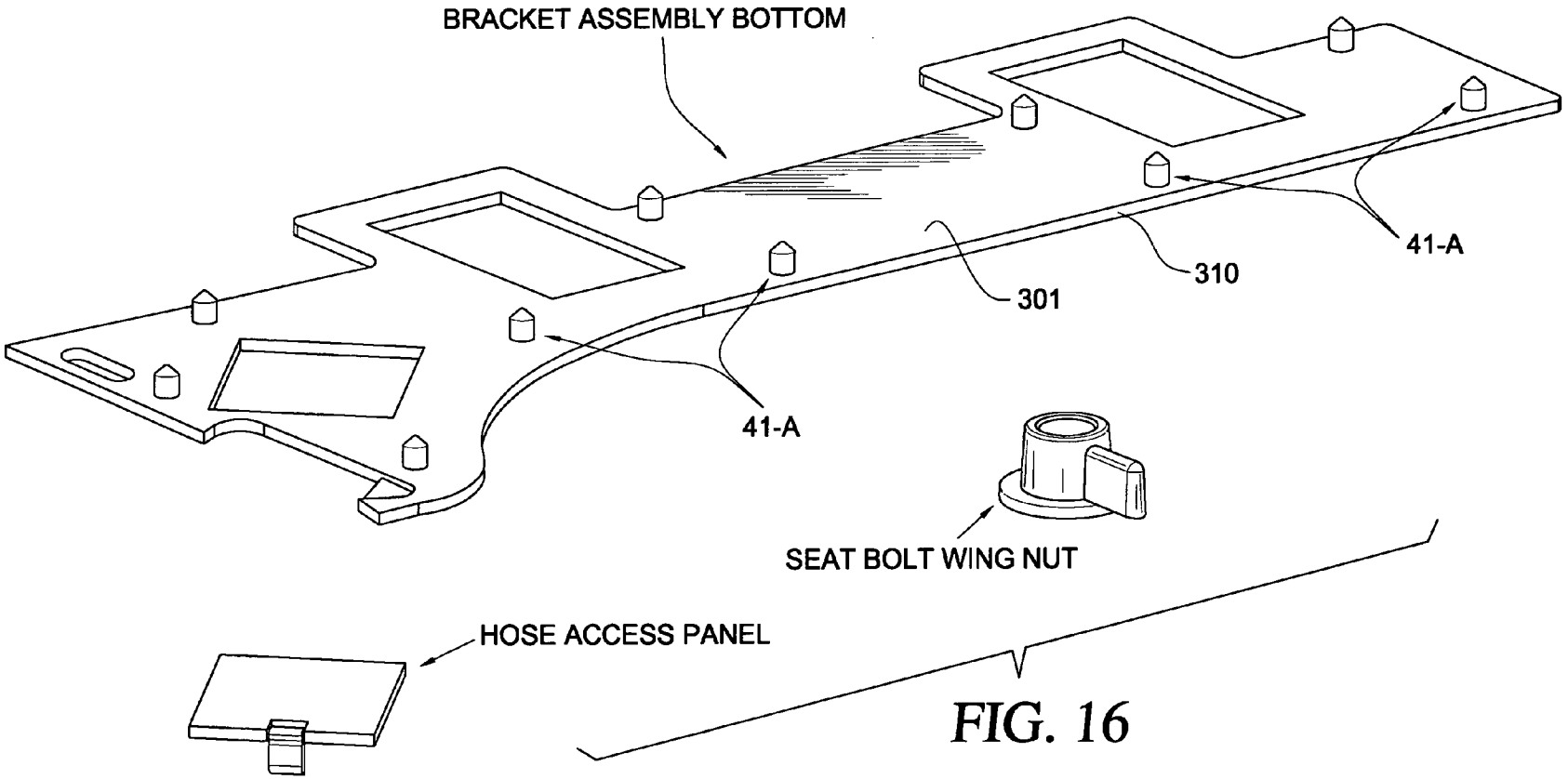

A pair of hoses H. H leading from nipples 73, 73 of mid sub-assembly B are threaded into bracket 13 of FIG. 1. Bracket 13 is comprised of a two-piece assembly with the top 300 being shown in FIG. 15 and its complementary bottom part 301 in FIG. 16. These pieces snap together to form a housing having a hollow interior due to the downwardly extending flange disposed around the top 300 engaging the peripheral edge 310 of bottom 301. Spaced openings 302, 302 receive the toilet hinges therein for securing the bracket to the toilet bowl. An opening 303 with a removable cover 304 is placed at one end and the hoses H, H, only one being shown, will be threaded into the opening 303 and into the hollow toilet seat for connection to the nozzles 30, 30, respectively, located at the front and rear of the toilet seat 11.

Cover C

Figure 17:
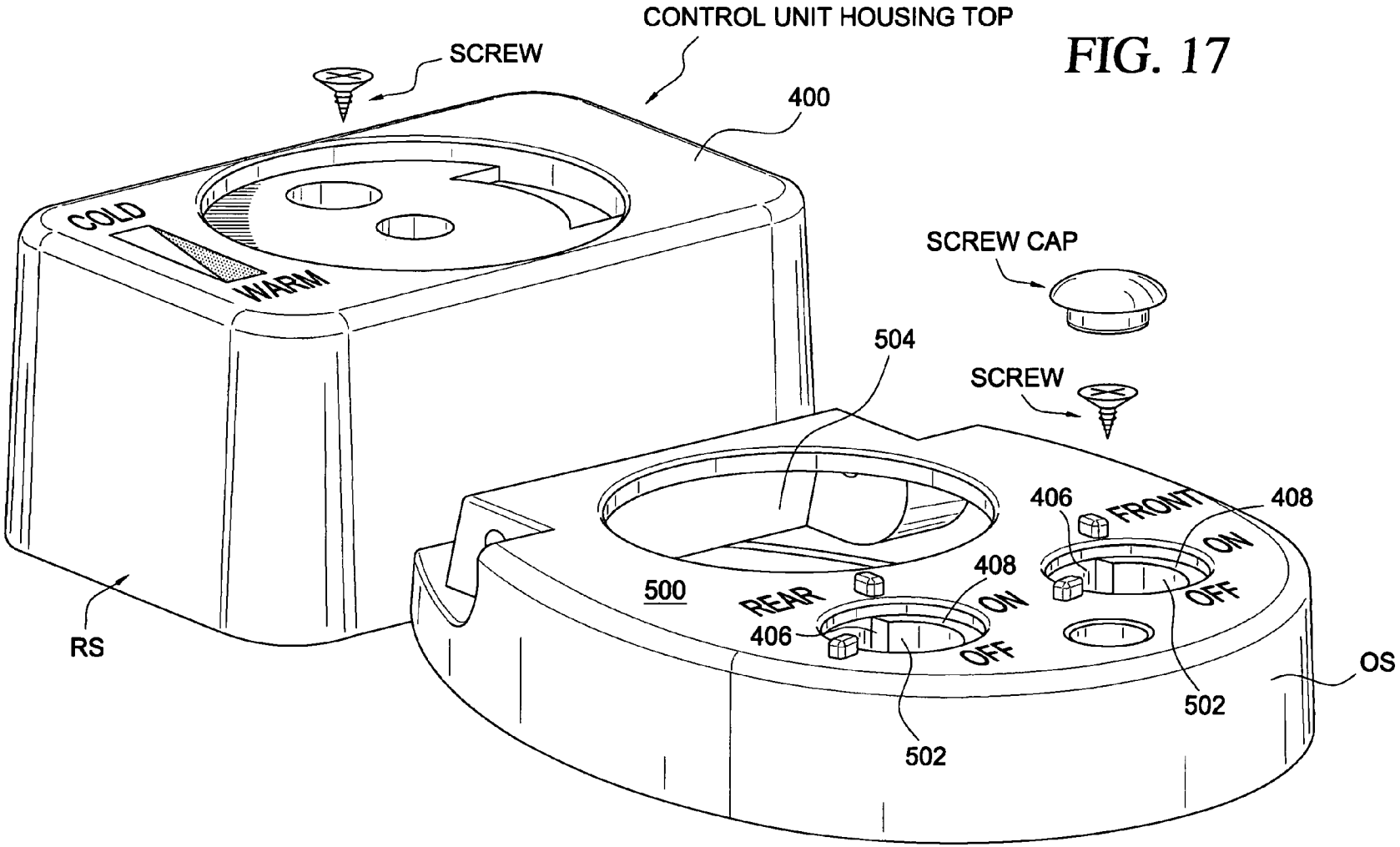
FIG. 17 shows the details of the cover.
Figure 18:
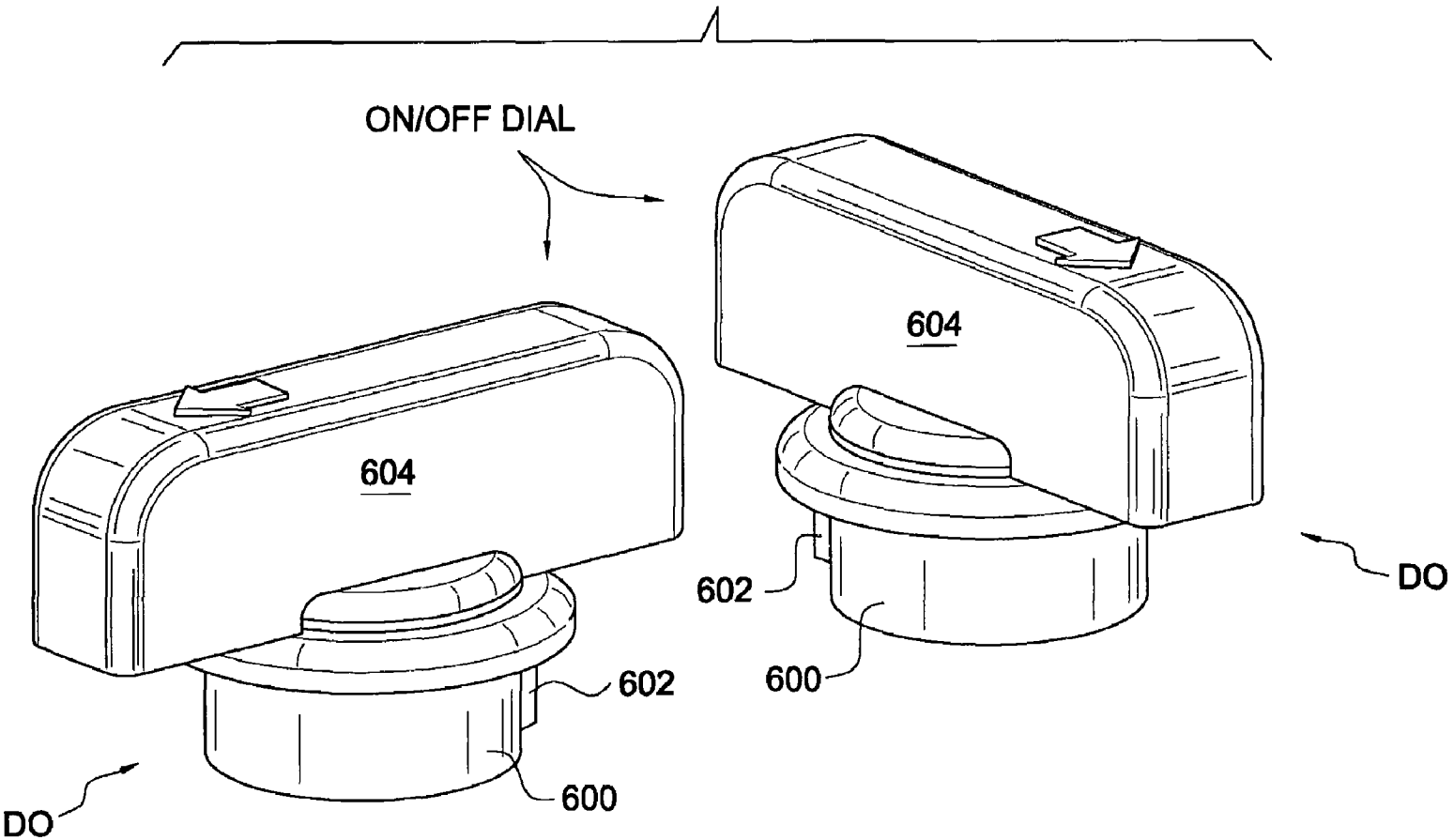
FIG. 18 shows the details of the control dials.

The cover shown in FIG. 17 includes an ovoid section OS and a rectangular section RS like that of base A and mid sub-assembly B with the section RS being raised a distance above the top surface 500 of the ovoid section OS. The top surface 500 is formed with a pair of like openings 502, 502 which align with the top of housings 91, 91 and a larger opening 504 which aligns with housing 90 of mid sub-assembly B. When cover C is placed onto mid sub-assembly B, the knurled portions of shafts 203, 203 will extend through the openings 502, 502 and dials DO, DO will be secured thereon. Likewise, the knob 103*a* of the pump assembly 100 will extend through the opening 504. Each of the openings 502, 502 have an interrupted circular flange 408, 408 formed at the bottom of the opening to accommodate key members formed on the bottom of dials DO, DO when disposed therein.

The details fo the dials DO, DO are shown in FIG. 17 and are seen to have a circular base 600, 600 with keys 602, 602 extending outwardly thereof, and finger-engaging knobs 604, 604 disposed on the top thereof. The dials are inserted into the respective openings 502, 502 with the keys 602, 602 free to rotate within the cut-out portion 406 of the flanges 408, 408. On and Off and Front and Rear indicia are inscribed on the surface 500 whereby, when the know is turned, the user can control the amount of fluid passing to the toilet seat nozzles as the keys limit the rotation of the knobs.

The cover is formed with an extension H which serves as a cover for the fittings 73, 73 extending outwardly of mid sub-assembly B and slotted into openings 53, 53.

Additionally, the top surface of rectangular section RS is provided with an opening receiving a dial and the disk control shaft therein, as seen in FIG. 2, which is designed to be limited in movement like the knobs DO, DO. Warm and Cold indicia is placed on the top surface to aid the user in the amount of mix and, therefore, the temperature of the water entering the bidet.

The ovoid section OS is recessed at the rear thereof and openings OP, OP are provided in the wall surface to pivotally receive nubs NS of transparent cover CO therein. The transparent cover is normally positioned over the top surface of the ovoid section and serves to protect the knobs. When the knobs are to be accessed, the cover is pivoted upwardly.

Assembly

To assemble the housing, the parts A, B and C being of the same general shape, are aligned with one another as shown in FIG. 2 and nested together to form the housing 10 as shown in FIG. 1. When part B, which is slightly smaller in dimension than part A, is nested in Part A the edge 53*a* thereof is disposed slightly above that edge 53*a* of part A and, upon application of pressure and heat to these parts, the fusion lines 76, 77 melt causing the parts A and B to fuse together whereupon the upper edge 53*a* of part B will move downwardly and be flush with edge 53*a* of part A.

Part C is then placed over the top of part B and is frictionally secured to part A by having the recessed upper peripheral edge PE, PE engaging the complementary lip L on part A. To further rigidify the parts, retention screws are threaded into openings OG, OG on the top surface which align with threaded openings in retention posts RP, RP disposed at either end of mid sub-assembly B. Thereafter hose connections are made to the hot and cold water lines and to the hoses connected to the toilet seat nozzles, as explained hereinabove.

As the described controls regulate the flow, temperature and water pressure, the water in the housing is always under pressure and, therefore, ready for instant use.

The user can adjust the inflow of water, the pressure thereof and, therefore, the pressure exiting into the nozzles and the position of the same to direct the flow to the body parts to be cleaned.

What is claimed is:

1. A housing, fluid always under pressure in said housing, a dispensing means disposed within the confines of said housing and including a reservoir, a reservoir inlet and a reservoir outlet in said reservoir, said reservoir outlet being disposed in said fluid under pressure, an additive in said reservoir, a biased flexible member covering said reservoir outlet and closing the same, and pump means forcing said additive out of said reservoir outlet against the bias of said flexible member, said fluid pressure ensuring that the additive will be dispensed into said fluid under pressure, a first and second housing inlet and a housing outlet for introducing fluid into and out of said housing, said first housing inlet adapted to be in communication with a cold water supply outlet and the second housing inlet is adapted to be in communication with a hot water outlet, a passageway positioned in said housing conducting the fluid to said reservoir, adjustable control means in said passageway regulating the pressure of said fluid therein, adjustable control means being disposed in said reservoir outlet for regulating the flow of said fluid out of said reservoir outlet, and a hose being connected to said housing outlet conducting said fluid to a nozzle disposed in a toilet seat.

2. The housing of claim 1 wherein the nozzle is adjustable.

3. The housing of claim 1 further including a second outlet conducting water to a second nozzle disposed in the toilet seat.

4. The housing of claim 1 wherein the said toilet seat has a hollow portion with said hose disposed therein.

5. The housing of claim 3 wherein the said toilet seat has a hollow portion with said second hose disposed therein.

6. The housing of claim 5 wherein the nozzles are disposed substantially opposite one another.

7. A housing, fluid always under pressure in said housing, a dispensing means disposed within the confines of said housing and including a reservoir, a reservoir inlet and a reservoir outlet in said reservoir, said reservoir outlet being disposed in said fluid under pressure, an additive in said reservoir, a biased flexible member covering said reservoir outlet and closing the same, and pump means forcing said additive out of said reservoir outlet against the bias of said flexible member, said fluid pressure ensuring that the additive will be dispensed into said fluid under pressure, a first and second housing inlet and a housing outlet for introducing fluid into and out of said housing, the housing being integrated with a toilet seat equipped with dispensing nozzles to be substituted for an existing toilet seat.

8. A housing, fluid always under pressure in said housing, a dispensing means disposed within the confines of said housing and including a reservoir, a reservoir inlet and a reservoir outlet in said reservoir, said reservoir outlet being disposed in said fluid under pressure, an additive in said reservoir, a biased flexible member covering said reservoir outlet and closing the same, and pump means forcing said additive out of said reservoir outlet against the bias of said flexible member, said fluid pressure ensuring that the additive will be dispensed into said fluid under pressure, a first and second housing inlet and a housing outlet for introducing fluid into and out of said housing, said first housing inlet adapted to be in communication with a cold water supply outlet and the second housing inlet is adapted to be in communication with a hot water outlet, a passageway positioned in said housing conducting the fluid to said reservoir, adjustable control means in said passageway regulating the pressure of said fluid therein, adjustable control means being disposed in said reservoir outlet for regulating the flow of said fluid out of said reservoir outlet, and adjustable control means being disposed in said first and second housing inlets for regulating the temperature and fluid pressure of said fluid entering said housing and said passageway.

* * * * *